US006350139B1

(12) United States Patent
Haag

(10) Patent No.: US 6,350,139 B1
(45) Date of Patent: Feb. 26, 2002

(54) TWIST-LOCK CONNECTOR FOR ELECTRICAL PLUG AND SOCKET

(75) Inventor: Philip E. Haag, Redwood City, CA (US)

(73) Assignee: Maverick Global Enterprises, LLC, Woodside, CA (US)

( * ) Notice: Subject to any disclaimer, the term of this patent is extended or adjusted under 35 U.S.C. 154(b) by 0 days.

(21) Appl. No.: 09/512,427

(22) Filed: Feb. 24, 2000

Related U.S. Application Data

(63) Continuation-in-part of application No. 09/032,355, filed on Feb. 27, 1998, which is a continuation-in-part of application No. 08/679,124, filed on Jul. 12, 1996, now Pat. No. 5,722,847.

(51) Int. Cl.[7] ..... H01R 13/62
(52) U.S. Cl. ..... 439/320; 439/481; 439/373
(58) Field of Search ..... 439/320, 484, 439/311–323, 306–310, 480, 481, 483, 373

(56) References Cited

U.S. PATENT DOCUMENTS 3,901,574 A * 8/1975 Paullus et al. ..... 439/314
5,087,209 A * 2/1992 Faucher ..... 439/320
5,344,333 A * 9/1994 Haag ..... 439/320

* cited by examiner

*Primary Examiner*—Gary Paumen
*Assistant Examiner*—Ross Goshi
(74) *Attorney, Agent, or Firm*—Roberts Abokhair & Mardula, LLC

(57) ABSTRACT

A twist-lock connector assembly for securing an engaged electrical plug to an electrical outlet which includes a rotatable cylindrical sleeve for enclosing an electrical plug and a modified cover plate for replacing the conventional cover plate of an electrical outlet, such as a wall socket or a portable power box. The forward end of the rotatable sleeve includes a plurality of external thread members. Each socket hole of the cover plate includes an inner cylindrical wall having a plurality of radially inwardly projecting nubs formed thereon. In use, the electrical plug is inserted into the socket portion of the wall outlet and the cylindrical sleeve is rotated about a ¼ turn. This causes the external threads on the rotatable sleeve to lockingly engaged the nubs disposed surrounding the socket opening(s) of the cover plate and thereby prevent the electrical plug from being accidentally pulled loose from the outlet by its connection with cover plate. In an alternate embodiment, a twist-lock connector assembly for securing an engaged electrical plug to a female socket portion of an extension cord is disclosed. The female socket is enclosed by a retractable sleeve provided with engaging nubs adapted to lockingly engage the external threads of the rotatable sleeve for the electrical plug. In another embodiment, the connector assembly is configured to provide rapid twist-locking connection between a female connector of an extension cord and the male connector end of a whip end or handle portion of an outdoor garden power tool.

11 Claims, 6 Drawing Sheets

TWIST-LOCK CONNECTOR FOR ELECTRICAL PLUG AND SOCKET

CROSS REFERENCE TO RELATED APPLICATION

This application is a continuation-in-part of application Ser. No. 09/032,355 filed Feb. 27, 1998, which in turn, is a continuation-in-part of application Ser. No. 08/679,124 filed Jul. 12, 1996, now U.S. Pat. No. 5,722,847.

TECHNICAL FIELD

The present invention relates to locking apparatus for electrical connectors, and more particularly, to a twist-lock connector assembly for maintaining engagement between an engaged electrical plug and a socket.

BACKGROUND OF THE INVENTION

When using electric powered appliances or power tools, it is necessary to maintain firm engagement between an engaged electrical plug and a wall outlet or power box in order to ensure an uninterrupted source of power to the appliance or power tool. Unintentional unplugging of an engaged electric power cord from a wall outlet can cause frustration and contribute to decreased productivity. For example, most people have experienced the common frustration of having the power cord of a vacuum cleaner unintentionally pulled loose from the wall socket several times while vacuuming.

As a further example, a computer plug which comes loose from its connection to a wall socket can result in loss of data. As another example, construction workers at a job site experience production losses each time they must re-plug a power tool that has come loose from a wall socket or power box during use.

Various techniques and devices have been proposed for ensuring engagement between an engaged electrical plug and wall outlet or power box. For example, in accordance with one prior art technique, the electrical plug is provided with a metal loop or fork tongue flange which is designed to be fastened by a screw to the center hole of the cover plate of the electrical outlet.

A disadvantage with this technique is that the cover plate center screw be loosened each time the electric plug is to be engaged or disengaged from the wall socket. Thus, this technique is extremely impractical for uses in which the electric plug will only be engaged for short time periods, such as is the case with the use of vacuum cleaners, gardening tools, power tools, etc. Further, this technique requires use of a screw driver each time the electric plug is to be locked in engagement with and unlocked from engagement with the wall socket. Further still, in the case where the electric plug to be engaged is a three prong plug, the presence of the third "ground" prong of the three prong plug means that the plug can only be inserted into the wall socket in one orientation. Since there is usually only one center screw hole located between the two socket access openings of the cover plate, only one electric plug having the metal loop or forked tongue flange can be screwed in place to the wall socket at a time. Accordingly, a connector arrangement for securing an engaged electric plug to a wall socket which does not require use of additional tools to make the locking connection and which can lockingly engage more than one electric plug to the respective socket portions of an electrical outlet at a time would be a big advance in the art.

In the case of exposed outlet boxes of the type commonly found on boat docks, it is the common practice to use leather straps, string or even tape to ensure that an engaged electric plug remains connected to the socket portion of the outlet box. It is also the common practice to bend or deform the conductor prongs of an electric plug to create a tighter fit inside the outlet. Obviously such practices are only temporary fixes and do not provide a long lasting secure engagement between and engaged electric plug and an electrical outlet.

My previous approach to solving this problem is disclosed in U.S. Pat. No. 5,344,333. This approach proposes to use a rotatable cylindrical sleeve for twist-locking an engaged electric plug to a cover plate of a wall outlet. In this design the cylindrical sleeve is provided with a first end adapted for snap fit insertion within a socket opening of the cover plate and a second end provided with grooves along an inner cylindrical surface thereof. The electric plug is provided with a circular face plate having threads formed along its outer surface. In use, the plug is engaged within the socket and the sleeve is rotated such that the grooves of the sleeve lockingly engage with the threads of the face plate on the electric plug.

While my earlier design works well and offers many advantages over the prior art techniques discussed above, there is still a problem since dirt and debris tends to collect in the sleeve over time and this can inhibit positive locking engagement. Also, in my earlier design, two hands are required to complete the locking engagement between the engaged electrical plug and the wall outlet. Accordingly, a twist-locking connector arrangement which overcomes these problems would be extremely desirable.

SUMMARY OF THE INVENTION

It is therefore a principle object of the present invention to provide a simple, low cost twist-lock connector assembly for securing an engaged electrical plug to a wall outlet or power box.

It is a related object of the invention to provide a twist-lock connector assembly of the type described herein which permits convenient single handed-locking operation and which does not require any tools to perform the locking operation.

Briefly, in accordance with a preferred embodiment, the twist-lock connector assembly of the present invention comprises two primary components including an axially rotatable cylindrical sleeve for enclosing the insulator body portion of an electrical plug and a modified cover plate which replaces the conventional cover plate that covers the metal electrical box of a wall socket. The cylindrical sleeve has a first sleeve end that extends a distance beyond the insulator body portion of the electrical plug in the direction of the protruding electrical conductors or prongs and a second sleeve end that is rotatably mounted to the insulator body portion of the electric plug. In use, the cylindrical sleeve is freely rotatable about the long axis of the electric plug. The first sleeve end includes a plurality of radially inwardly projecting nubs provided along an inner cylindrical surface thereof.

The modified cover plate is similar in design to a conventional cover plate except that it includes an upstanding cylindrical wall disposed about a periphery of each socket access opening. Each of the upstanding cylindrical walls is provided with a plurality of spaced apart discontinuous thread members formed along their respective exterior wall surfaces. The diameter of each upstanding cylindrical wall is dimensioned to provide a close tolerance fit within the first sleeve end of the cylindrical sleeve. Also, the thread members on the exterior wall surfaces are designed to matingly engage the nubs on the inner cylindrical surface of the first sleeve end as the sleeve is twist-rotated over the upstanding cylindrical wall.

In use, the electrical plug is inserted into the socket portion of the wall outlet and the cylindrical sleeve is rotated about a ¼ turn. This causes the inner disposed nubs of the sleeve to lockingly engage the outer disposed threads of the upstanding cylindrical wall of the cover plate. The electrical plug is prevented from being accidentally pulled loose from the outlet by its connection with the second sleeve end of the cylindrical sleeve.

An advantage of the present invention over of the thread-in-groove twist-lock connector designs of the prior art is that the use of projecting nubs on the sleeve instead receiving grooves substantially eliminates the aforementioned problem of dirt and debris collecting in the sleeve and inhibiting positive twist-locking engagement of the locking structure.

The location of the rotatable sleeve on the electrical plug also advantageously facilitates single-handed twist-locking operation by a user.

In an alternate embodiment of the invention, the twist-lock connector assembly comprises three components: namely, a cover plate for attaching to a wall socket, a shortened cylindrical sleeve, and an adapter or face plate that attaches to or forms an integral part of the prong end of the electrical plug. The shortened cylindrical sleeve includes a first sleeve end adapted for snap fit insertion into the socket access openings of the cover plate and a second sleeve end having a plurality of spaced apart nubs disposed along an inner cylindrical surface thereof. Once snap fitted in place on the cover plate, the shortened cylindrical sleeve is permitted to axially rotate with respect to the cover plate. The face plate on the prong end of the electrical plug is provided with a plurality of external threads. In use, the electrical plug is plugged into the socket portion of the wall outlet and the shortened cylindrical sleeve is rotated so that the internally disposed nubs on the second sleeve inner cylindrical surface lockingly engage the external threads on the face plate of the electrical plug.

In still another embodiment of the invention, the twist-lock connector assembly includes a rotatable sleeve housing for enclosing the electrical plug. The rotatable sleeve includes external threads formed along a forward end portion thereof. The twist-lock connector assembly also includes a modified wall socket cover plate having socket receiving holes provided with spaced apart, inwardly projecting nubs formed integral along an inner cylindrical wall surrounding each of the socket receiving holes. In use, the conductor prongs of the electrical plug are inserted into the corresponding receiving holes of the wall socket and the sleeve is rotated thereby causing the external threads of the rotatable sleeve to lockingly engage the nubs of the cover plate.

In yet another embodiment of the invention, the twist-lock connector assembly is adapted for maintaining engagement of an electrical plug with a female socket end of an extension cord. This embodiment is directed specifically towards maintaining engagement between extension cords and power tools and/or appliances having a male electrical connector or prong end that is attached by a whip portion to, or is formed integral with, the handle structure of a power tool or appliance. For example, such connectors are commonly found on most outdoor garden tools, such as, leaf blowers and vacuums, hedge clippers, etc. In this embodiment, the male or prong end of the electrical connector on the whip or in the handle is provided with a face plate member having a cylindrical outer wall with a plurality of threads formed thereon. As before, the female or socket end of the connector assembly is provided with a twist rotatable and retractable sleeve having the inwardly projecting nubs formed integral along a forwardmost portion of the inner sleeve wall. In use, the conductor prongs of the electrical plug are inserted into the corresponding receiving holes of the female socket portion and the sleeve is rotated thereby causing the inwardly projecting nubs of the rotatable sleeve to lockingly engage the threads on the cover plate member. The cover plate member may be formed integral with the male insulator body portion or may be provided as an after market piece.

Another advantage afforded by the present invention is the extended operating life and reliability of the electrical contacting components of the electrical plug and socket assemblies since the twist-lock feature of the connector assembly substantially reduces tensional forces on the electrical plug and thereby prevents excess wear of the electrical contact surfaces of the female socket and male electrical plug assemblies.

Methods and apparatus which incorporate the features described above and which are effective to function as described above constitute specific objects of this invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

The accompanying drawings incorporated in and forming a part of the specification, illustrate several aspects of the present invention, and together with the description serve to explain the principles of the invention.

Reference will now be made in detail to various present preferred embodiments of the invention, examples of which are illustrated in the accompanying drawings.

DETAILED DESCRIPTION OF THE PREFERRED EMBODIMENTS

Figure 1:
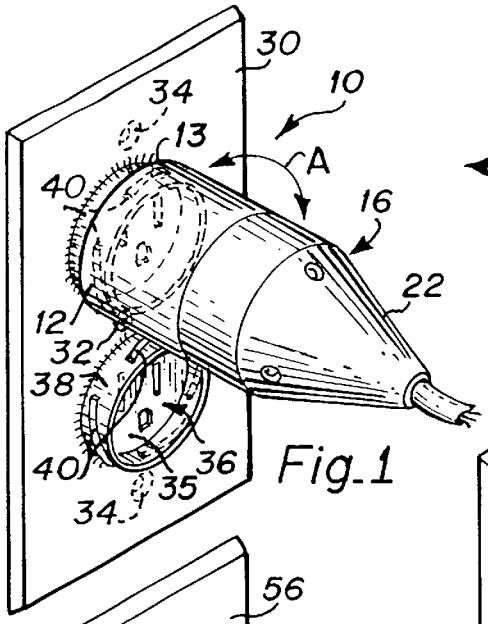
FIG. 1 is an isometric perspective view of a twist-lock connector assembly for maintaining engagement between an engaged electrical plug and a wall socket in accordance with one embodiment of the present invention.
Figure 3:
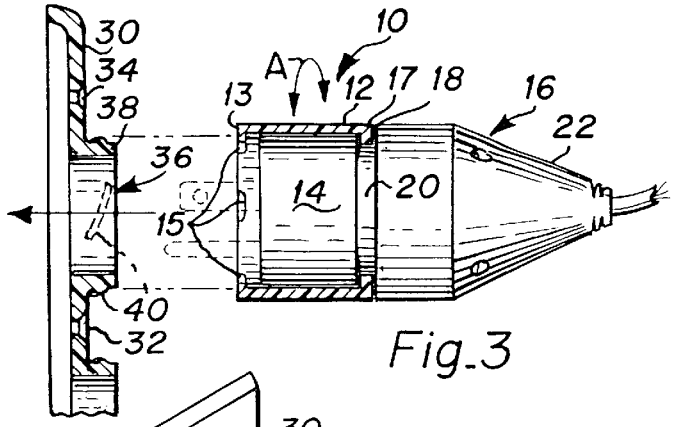
FIG. 3 is a cross sectional side elevation view of the twist-lock connector assembly of FIG. 2.
Figure 2:
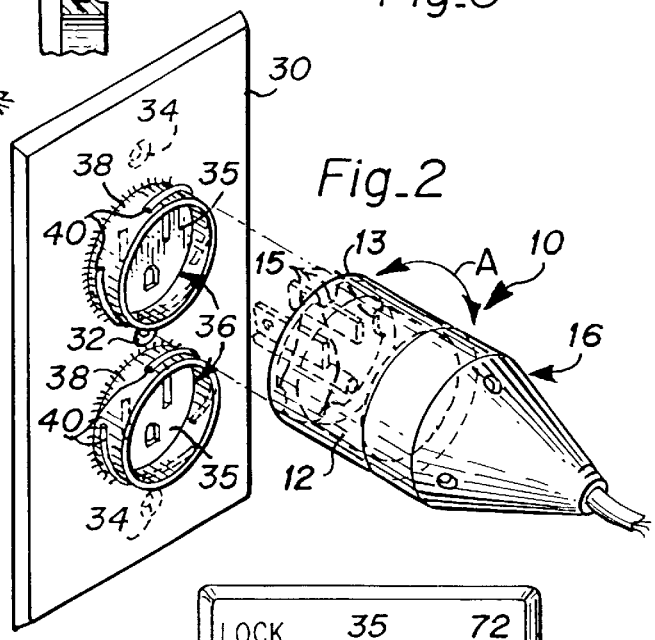
FIG. 2 is an isometric perspective view similar to that of FIG. 1 but showing the electrical plug disengaged from the wall socket.

A twist-lock connector assembly for use in maintaining engagement between and engaged electrical plug and a wall socket constructed in accordance with one embodiment of the present invention is generally designated by reference numeral 10 in FIGS. 1–3.

The twist-lock connector assembly 10 includes a generally cylindrical sleeve 12 which encloses the insulator body portion 14 of the electrical plug 16. As best seen in FIG. 3, the sleeve 12 includes a first sleeve end 13 which extends in a forward direction a distance beyond the insulator body portion 14 such that it partially encloses the electrical conductors or prongs (shown in phantom) of the electrical plug 16. The first sleeve end 13 has an inner cylindrical surface provided with a plurality of evenly spaced apart nubs 15.

The sleeve 12 also includes a second sleeve end 17 having rotatable mounting means for rotatably mounting the sleeve 12 to the electrical plug 16 so that the sleeve 12 is freely axially rotatable about the long axis of the electrical plug 16 as indicated by directional arrow A. The rotatable mounting means also serve to attach or tether the sleeve 12 to the electrical plug 16 in a way which keeps the sleeve 12 in a preferred axial relationship with the insulator body portion 14 as shown. In a preferred embodiment, the rotatable mounting means include a notched key way 18 disposed at a rearwardmost end of the sleeve 12. The key way 18 is adapted to be slidably received within an annular slot or gap 20 provided to the electrical plug 16. In this example, the gap 20 is formed by the presence of the insulator body portion 14 on one side and a fixed conical housing portion 22 on the other side.

There are, of course, many other possible alternative structural arrangements for rotatably mounting the sleeve to the electrical plug in a way that keeps the sleeve in a desired axial relationship with the electrical plug (i.e., where the first sleeve end 13 with the nubs 15 is positioned just forwardly of the insulator body portion 14 of the electrical plug 16). For example, the conical end portion 22 may be formed integral with the cylindrical sleeve 12 (in this case the conical end portion would not be fixed or held by screws to the electrical plug 16). The tapered end of the conical end portion of such a modified sleeve would include a hole for receiving the power cord of the electrical plug. An additional keeper, such as a ring or similar member (not shown) could be installed on the power cord to restrain rearward displacement of the conical end portion relative to the electrical plug 16 and thus keep the sleeve in a desired axial relationship with the electrical plug.

The twist-lock connector assembly 10 also includes a modified cover plate 30 which replaces the conventional cover plate of a wall socket. The modified cover plate 30 preferably includes a center hole 32 for receiving a fastening screw (not shown) to secure the cover plate 30 to the conventional center screw location of the wall socket. This is best seen in FIGS. 2 and 3. Alternatively, as is shown in FIG. 1, the cover plate may include top and bottom screw holes 34 (shown in phantom) for attaching the cover plate 30 to the top and bottom screw mounts of the metal box that houses the electrical socket portions 35 of the wall socket.

The cover plate 30 is provided with socket access openings 36 which are formed with a surrounding upstanding perimeter wall 38. Each wall 38 defines a cylindrical opening having a diameter sized for close tolerance fit within the cylindrical opening of the first sleeve end 13. The outer surface of wall 38 includes a plurality of external threads 40. The threads lockingly engage the nubs 15 of the first sleeve end 13 as the electrical plug is inserted into the socket portion 35 and the sleeve 12 is rotated in a clockwise direction (for a right hand thread). In this manner the rotatable sleeve 12 is twist-locked onto the grooved upstanding cylindrical wall 38 of the cover plate 30 and therefore provides a positive locked engagement between the engaged electrical plug 16 and the socket portion 35 of the wall socket. To disengage the electrical plug from the wall socket, the sleeve 12 is simply rotated in a reverse orientation which, in turn, frees the nubs 15 from locking engagement with the external threads 40 of the upstanding cylindrical wall 38 of the cover plate 30.

In a preferred embodiment of the invention, there are four nubs 15 and there are four discontinuous threads 40 which are arranged in a conventional four (4) point thread configuration of the cross hair type. This simple arrangement permits twist-locking and unlocking operation with only about a ¼ turn of the sleeve in either direction required. A greater number of threads and nubs may be used if desired.

Figure 4:
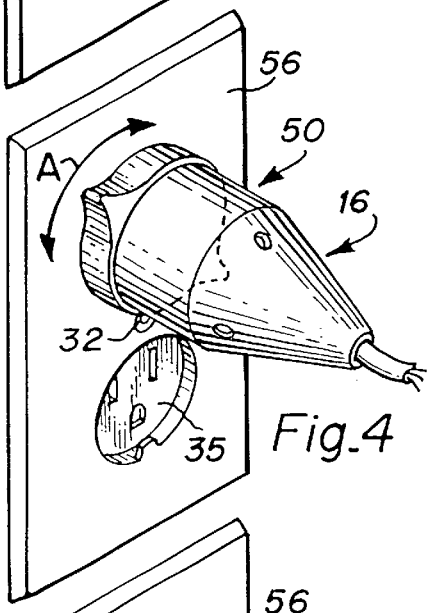
FIG. 4 is an isometric perspective view of a twist-lock connector assembly for maintaining engagement between an engaged electrical plug and a wall socket in accordance with a second embodiment of the present invention.
Figure 5:
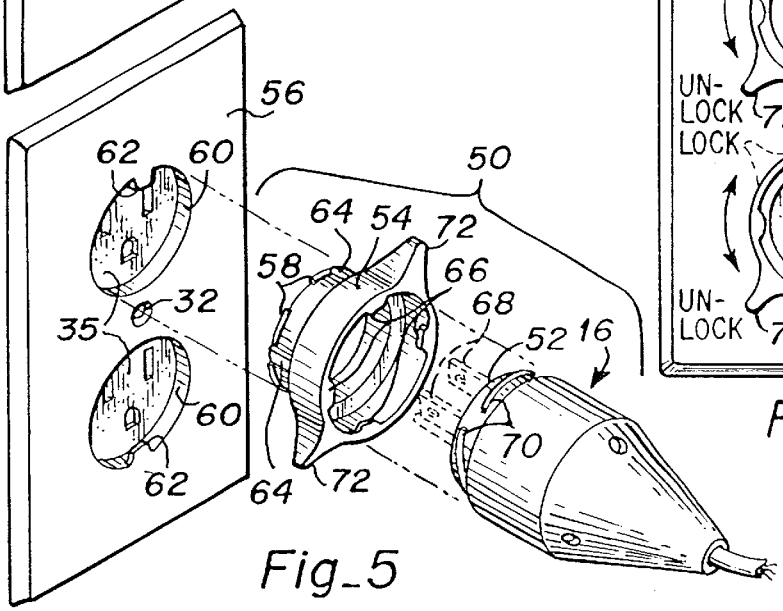
FIG. 5 is an isometric perspective view of a second embodiment of the present invention similar to FIG. 4 but showing the electrical plug disengaged from the wall socket.

A twist-lock connector assembly constructed in accordance with a second embodiment of the present invention is designated generally by reference numeral 50 in FIGS. 4 and 5.

The twist-lock connector assembly 50 includes: a face plate 52 attached to or formed integral with a prong end of an electrical plug 16; a modified cover plate 56 for replacing the conventional cover plate of a wall socket or power box; and a cylindrical sleeve 54 for rotatably securing the face plate 52 to the cover plate 56. The sleeve 54 is a modified and shortened version of the sleeve 13 of the embodiment described above with reference to FIGS. 1–3 and includes a first sleeve end having perimeter rib segments 58 adapted for snap fit insertion within the socket access openings 60 of the cover plate 56. Each of the socket access openings 60 preferably include at least one inwardly extended tab or stop member 62 which, in use, abuts against axial stops 64 provided to the first sleeve end to limit the range of axial rotation of the sleeve 54 within the socket access openings 60. This feature will be discussed in more detail below with reference to FIG. 6.

The sleeve 54 also includes a second sleeve end having an inner cylindrical surface formed with a plurality of spaced nubs 66. The inner cylindrical surface of the sleeve second end is sized for close tolerance fit over the face plate 52 of the electrical plug 16. Upon engagement of the conductors elements 68 (shown in phantom) of the electrical plug 16 by the corresponding receiving slots of the socket portion 35 of the wall socket, the sleeve is twist-rotated as indicated by arrow A in FIG. 4. This causes the nubs 66 to lockingly engage external threads 70 provided on the face plate 52, thereby locking the electrical plug 16 to the cover plate 56. The rotatable sleeve 54 preferably includes finger tabs 72 to facilitate the twist-lock operation by a user.

Figure 6:
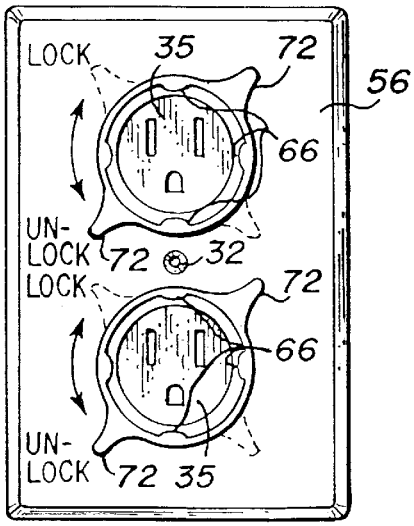
FIG. 6 is a front elevational view of th wall socket cover plate of FIG. 5.

Referring now to FIG. 6, the two finger tabs 72 on each of the sleeves 54 are preferably oriented diagonally opposite to one another such that they lie at about the two o'clock and eight o'clock positions of the socket access openings when the sleeve 54 is in the unlocked position. When the sleeve is rotated to the locked position, the finger tabs 72 move to about the four o'clock and ten o'clock positions, respectively. A greater or lesser range of axial rotation of the sleeve 54 within each socket access opening 60 can be made by adjusting the placement of the axial stops 64 of the sleeve first end which abut against the tab 62 at the fully locked and unlocked positions of the rotatable sleeve. The placement of the axial stops 64 with respect to finger tabs 72 of each sleeve is also selected to ensure that the finger tabs of the top and bottom sleeve do not overlap and interfere with one another.

Figure 7:
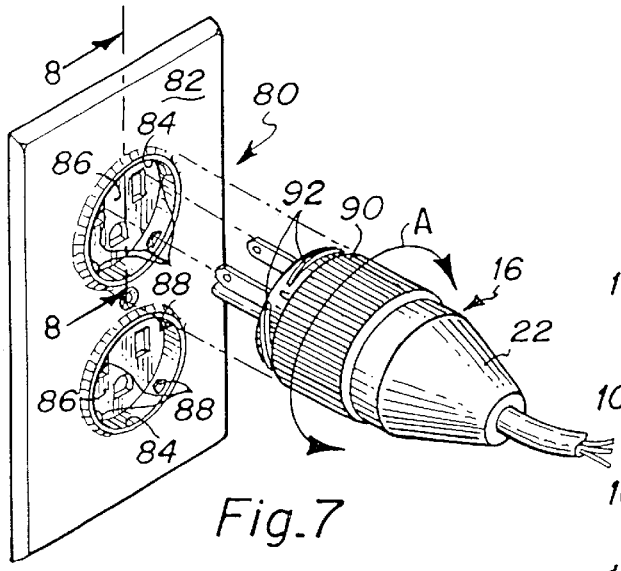
FIG. 7 is an isometric perspective view of a twist-lock connector assembly for maintaining engagement between an engaged electrical plug and a wall socket in accordance with a third embodiment of the present invention.
Figure 8:
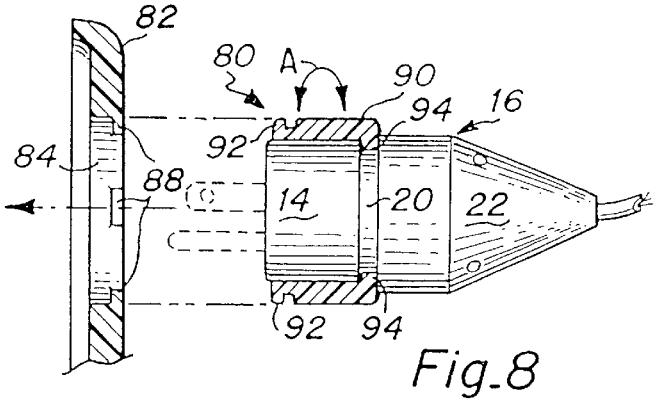
FIG. 8 is a cross section view through the wall socket plate assembly and rotatable sleeve taken along the line and in the direction of arrows 8—8 of FIG. 7.

A twist-lock connector assembly for maintaining engagement between an engaged electrical plug and a wall socket constructed in accordance with a third embodiment of the present invention is designated generally by reference numeral 80 in FIGS. 7–8.

The twist-lock connector assembly 80 includes a wall socket cover plate 82 for replacing the conventional cover plate of a wall socket or power box. The cover plate 82 includes openings 84 sized and positioned to permit plug-in access by a male electrical plug assembly 16 to the wall socket portions 86 of the wall outlet. Each opening 84 has an inner cylindrical wall provided with a plurality of spaced apart, radially inwardly projecting nubs 88, with four nubs spaced at regular intervals being preferred. The depth of the inner cylindrical wall of each opening 84 is sufficient to permit full twist-locking engagement with the external threads of the rotatable sleeve member provided to the male electrical connector assembly (described below).

The twist-lock connector assembly 80 further includes a rotatable cylindrical sleeve 90 for enclosing the insulator body portion 14 of male electrical plug assembly 16. The axial rotation of the sleeve 90 about a long axis of the electrical plug 16 as indicated by directional arrow A. The sleeve 90 is provided with a plurality of external threads 92 at a first, forward end thereof. The threads 94 are configured in size and number to facilitate cooperative twist-locking engagement with the nubs 88 of the access openings 84 of wall socket cover plate 82. The sleeve 90 also includes means for retaining rotatable engagement with the male plug assembly 16. In the exemplary embodiment shown, the retaining means includes a notched key way 94 disposed at a second, rearward end of the sleeve 90.

Just as in the embodiment described above with reference to FIG. 3, the notched key way 94 is adapted to be rotatably secured within an annular slot or gap 20 formed in the insulator body portion 14 of the electrical plug assembly 16. As before, the electrical plug assembly may include a fixed conical housing portion 22 to complete the cosmetically pleasing tapered outer appearance of the electrical plug assembly 16.

Also, in the preferred embodiment of the invention, there are four nubs 88 and there are four discontinuous threads 92 which are arranged in a conventional four (4) point thread configuration of the cross hair type. This simple arrangement permits twist-locking and unlocking operation with only about a ¼ turn of the sleeve in either direction required. A greater number of threads and nubs may be used if desired.

The wall socket cover plate 82 of the present invention is intended to be a permanent replacement for conventional wall socket cover plates presently in use in the home or business. It is recognized that users will continue to use the wall outlet for plugging in conventional electrical plugs (i.e., those plugs not provided with twist-lock engaging structure) in addition to electrical plugs provided with the specially configured twist-lock connecting structure of the present invention. It is also recognized that the inwardly projecting nubs 88 provided to the openings 84 of the cover plate 82 may inhibit proper plug-to-socket engagement with certain of the large diameter male plug configurations in use today.

Figure 10:
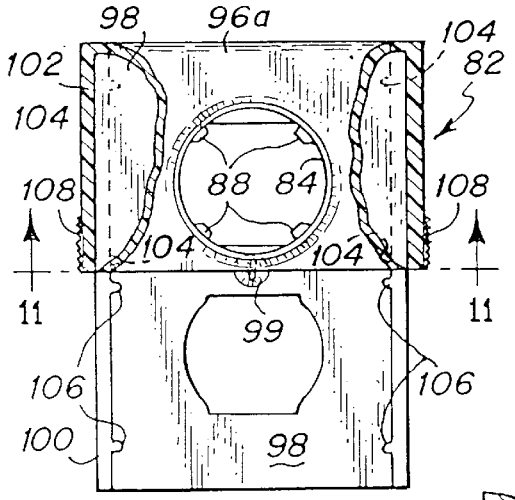
Figure 11:
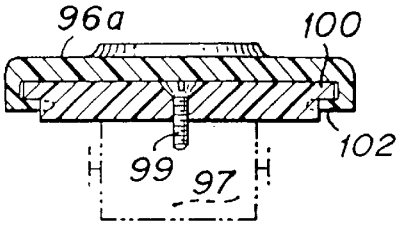
FIG. 11 is a section view through the wall socket cover pate assembly taken along the line and in the direction of arrows 11—11 of FIG. 10.

With reference to FIGS. 10–11, this potential problem is overcome by designing the cover plate 82 as a retractable cover plate assembly including retractable outer cover plate portions 96*a*, 96*b* and inner cover plate 98. The nubs 88 are formed along the inner cylindrical wall of the openings 84 of the outer cover plate portions 96*a*, 96*b*. The access openings and thickness of the inner cover plate 98 are the same as a conventional cover plate so as to be fully plug-in compatible with conventional electrical plug configurations. The inner cover plate 98 is secured to the wall socket 99 by a center screw fastener 99 in the conventional way (see FIG. 11).

Figure 9:
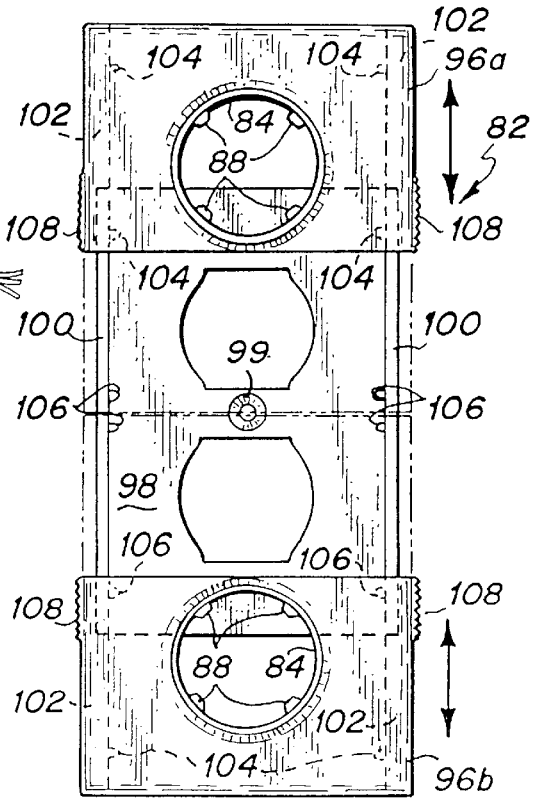
FIGS. 9–10 is a series of front views illustrating the retracted, open position (FIG. 9) and closed position (FIG. 10) of a wall socket cover plate assembly in accordance with another embodiment of the invention.

Suitable tongue-in-groove retractable sliding means are provided to the mating surfaces of the inner cover plate 98 and outer cover plate portions 96*a*, 96*b* (e.g., tongue 100 on inner cover plate 98 and groove 102 on outer cover plate portions 96*a*, 96*b*) to facilitate movement of the outer cover plate portions out of position so as to expose the inner cover plate. The above described retractable feature of the outer cover plate portions permits any conventional electrical plug unobstructed plug-in access to the wall socket. Detents or nubs 104 and conforming receiving indents 106 may be provided to the respective groove 102 and tongue 100 surfaces to lock the outer cover plate portions 96*a*, 96*b* in either the fully retracted, open (FIG. 9) or closed positions (FIG. 10). The outer cover plate portions 96*a*, 96*b* may further include ribbed or serrated edge regions 108 to facilitate handling by a user when moving the outer cover plate portions 96*a*, 96*b* into or out of position.

It is understood that above described embodiment for the retractable, twist-lockable cover plate assembly is capable of variation and modification while still achieving the basic objective of moving the outer plate portion or portions out of the way to permit unobstructed plug-in access by a conventional electrical plug to the female socket portion underneath. For example, the outer plate portions of the cover plate assembly may be pivotally attached to the inner plate either by a suitable hinge or other conventional pivot structure. In addition, the cover plate portions could be configured as a single outer plate member that is rotatably, pivotally or otherwise removably attached (e.g., by snap-fit attachment) to the inner plate portion.

Figure 12:
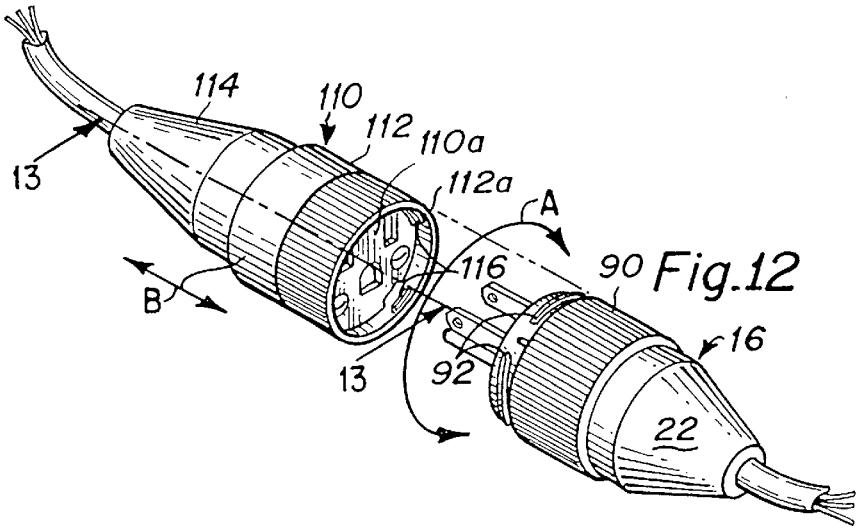
FIG. 12 is an isometric perspective view of a twist-lock connector assembly for maintaining engagement between an engaged electrical plug and a female socket portion of an electrical extension cord in accordance with a fourth embodiment of the present invention.
Figure 13:
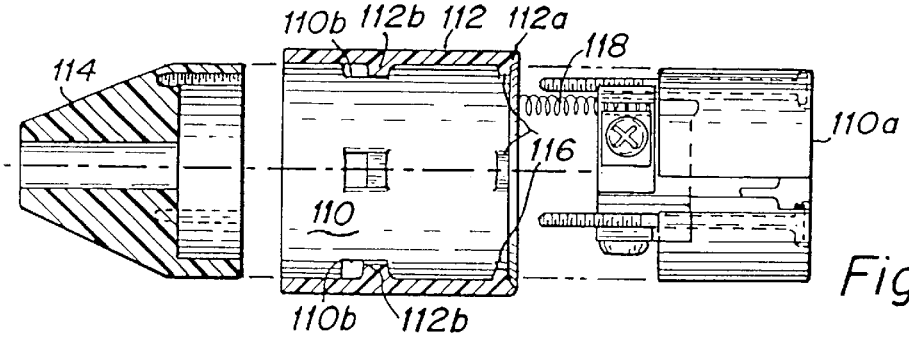
FIG. 13 is an exploded isometric cross section view through the connector housing assembly of the female socket taken along the line and in the direction of arrows 13—13 of FIG. 12.

With reference to FIGS. 12–13, there is shown a twist-lock connector assembly for maintaining engagement between an engaged electrical plug and a female socket portion of an electrical extension cord in accordance with a fourth embodiment of the present invention. In this embodiment, the insulator body portion 14 of the male electrical plug assembly 16 is provided with the same twist-lock connecting structure as described above in connection with the embodiment shown in FIGS. 7 and 8. That is to say, the insulator body portion 14 is enclosed the rotatable sleeve 90 with the external threads 92 disposed at the forward or prong end of the electrical plug assembly 16.

The female socket 110 is enclosed by a retractable sleeve 112 and a fixed conical end housing 114. The retractable sleeve 112 is retractably coupled to the female socket 110 to permit a desired amount of translational movement of the sleeve 112 between a first, fully retracted position wherein a forward end 112*a* of sleeve 112 lies substantially flush with the front face 110*a* of the female socket 110 and a second, extended position wherein the forward end 112*b* of the sleeve 112 extends a distance beyond the front face 110*a* of the female socket 110. This range of translational movement is indicated by direction arrow B in FIG. 12. The forward end 112*a* of the sleeve 112 is provided with a plurality of spaced apart, radially inwardly projecting nubs 116.

As best seen in FIG. 13, the underside of sleeve 112 includes one or more tab members tab member 112*b* that ride within corresponding slots 110*b* provided to the exterior surface of the female socket 110. Alternately, the tab member 112*b* may be configured as a single annular protrusion and the slot may be configured as a single annular slot. In this case, the retractable sleeve 112 would also be permitted to rotate axially about the female socket 110. The tab and slot dimensions are configured so as to provide a desired range of translational motion to the forward end 112*a* of the sleeve 112 beyond the face 110*a* of the female socket 110. Also, as an option the retractable sleeve 112 may be biased into a normally extended position by a spring 118.

In operation, twist-lock engagement of the male electrical plug to the female socket is performed as follows. First, the conductor prongs of the male electrical plug assembly 16 are inserted into the corresponding receiving holes of the female socket 110. The sleeve 112 is then moved into its extended position (if not already biased into the extended position by spring 1180) so that nubs 116 extend beyond the front face 110*a* of the female socket a distance sufficient to provide full engagement with the threads 92 of the rotatable sleeve 90 of the male electrical plug assembly 16. Next, the user simply rotates the sleeve 90 in a tightening direction (e.g., clockwise for right hand thread, counter clockwise for a left hand thread). The tightening rotation of sleeve 90 draws the threads 92 into engagement with the nubs 116 which pulls the conductor prongs of the male electrical plug 16 the remaining distance into the corresponding receiving holes of the female socket 110. To disengage the male electrical plug 16 from the female socket 110, the rotation of rotatable sleeve 90 is reversed so that the threads 92 disengage from the nubs 116.

Figure 14:
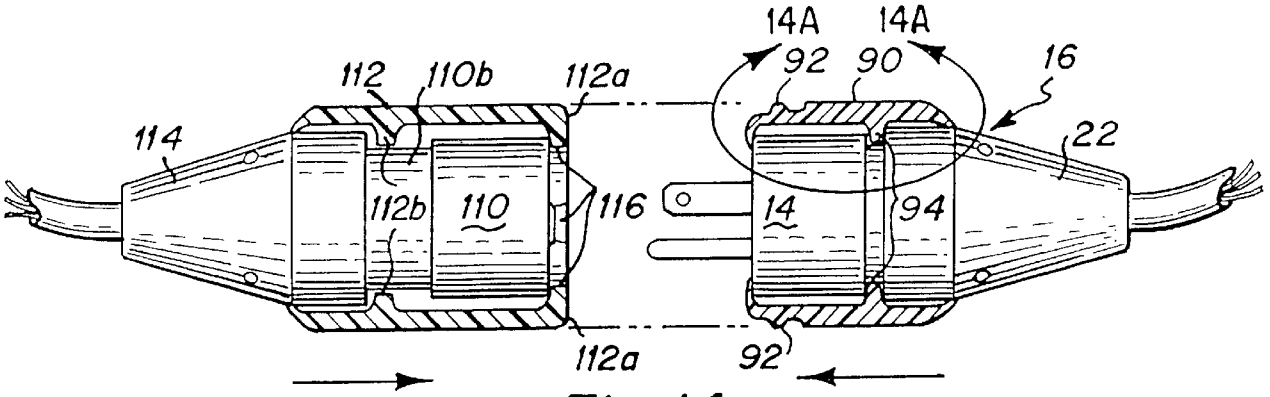
FIG. 14 is a side elevation view of the twist-lock electrical connector assembly shown in FIG. 12 showing, in cross section, the twist-lock connecting structure provided to the female and male plug assemblies.
Figure 14A:
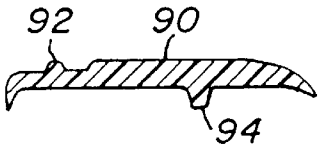
FIG. 14A is an enlarged fragmentary view of the region encircled by arrows 14A—14A of FIG. 14.

As is best seen in FIGS. 14 and 14*a*, either or both of the forward and rear ends of the rotatable sleeve 90 and the retractable sleeve 112 may be thinned and tapered to provide a seal against dust, moisture and like contaminants. Such "dust seals" may also be provided to any or all of the previously described embodiments.

Figure 15:
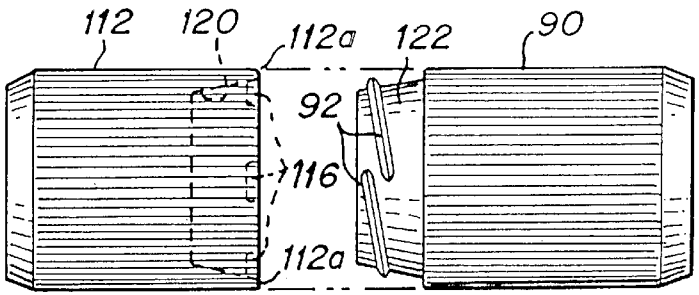
FIG. 15 is a side elevation view of twist-lock connecting structure for male and female electrical plug assemblies and which shows conforming tapered regions at the regions of engagement for providing a compression fit.

With reference to FIG. 15, the respective engaging surfaces at the forward ends of the rotatable sleeve 90 and the retractable sleeve may be conformingly tapered to provide a desired compression fit upon twist lock engagement. In the example shown, the receiving inner cylindrical wall 120 at the forward end 112*a* of retractable sleeve 112 and the outer cylindrical wall 122 at the threaded end 92 of rotatable sleeve 90 are matingly frusto-conical. The inner cylindrical wall surrounding each access opening 84 of the face plate 82 of the embodiments shown in FIGS. 7–11 may also be conically tapered to provide a desired compression fit with an electrical plug having the appropriately configured twist-lock engagement structure.

Figure 16:
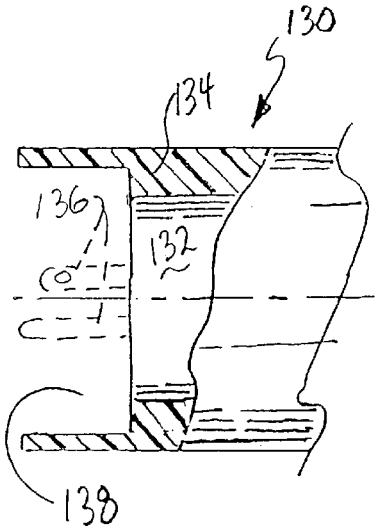
Fig 16 (PRIOR ART)
FIG. 16 is a partial cross-sectional view through an electrical connector or prong end of a handle or whip portion of a garden tool in accordance with the prior art.

FIG. 16 shows the recessed prong end 130 typically found in the handle or whip portions of outdoor garden tools. The male insulator body portion 132 is contained a housing 134 that is either formed integral with the handle for the garden tool or provided as a short whip portion connected to the handle of the garden tool. The prongs 136 (they may include just two prongs or a third ground prong) are set back within a recessed area 138 of the housing 134. In use, the female socket portion of an electrical cord (not shown) is received within the recessed area 138 for receiving engagement with the prongs 136.

Figure 17:
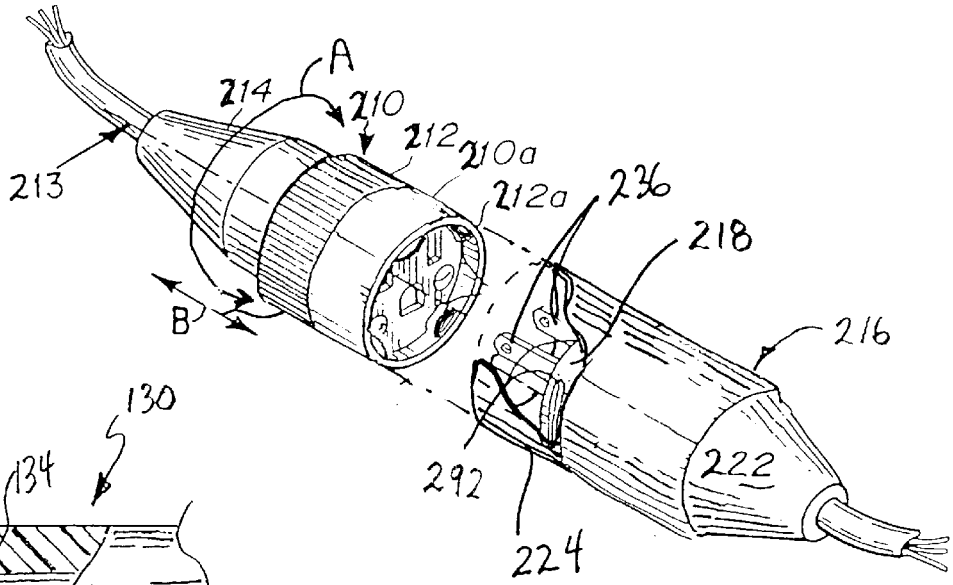
FIG. 17 is an isometric perspective view in partial cut away of a twist-lock connector assembly for maintaining engagement between an electrical plug and a female socket portion of an electrical extension cord in accordance with a fifth embodiment of the present invention.

FIG. 17 shows an adaption of the present invention for twist-locking engagement with the whip end of a garden tool in accordance with a fifth embodiment of the present invention. In this embodiment, the insulator body portion of the male electrical plug assembly 216 is provided with a face plate member 218 having a plurality of threads 292 formed along an outer cylindrical wall of the face plate member 218. The threads 292 preferably comprise four or five discreet thread members like those shown in the previous embodiments. In this embodiment, the face plate member 218 is connected to the male insulator body and may be removably fixed thereto by screws, or like mechanical fasteners, or may be formed integral with the male insulator body or formed integral with the housing 222 that encloses the male insulator body. Here, the male electrical plug assembly 216 is embodied as a recessed connection formed as part of a whip connector end or handle portion of a conventional outdoor garden power tool. The housing 224 of the whip connector end or outdoor garden tool handle structure extends around the face plate member 218 and prongs or conductors 236 and is sized sufficiently large in diameter to enclosed the leading edge portion of the rotatable and retractable sleeve 112.

Just as described above in connection with the embodiment shown in FIGS. 12–13, the female socket 210 is enclosed by a sleeve 212 and a fixed conical end housing 214. The sleeve 212 is retractably coupled to the female socket 210 to permit a desired amount of translational movement (indicated by arrow B) of the sleeve 212 between a first, fully retracted position wherein a forward end 212*a* of sleeve 212 lies substantially flush with the front face 210*a* of the female socket 210 and a second, extended position wherein the forward end 212*b* of the sleeve 212 extends a distance beyond the front face 210*a* of the female socket 210. The underside of sleeve 212 includes radially inwardly extending tab members 212*b* that are received within corresponding annular slot 210*b* provided to the exterior surface of the female socket 210. Alternately, the tab members 212*b* may be configured as a single annular protrusion. In this case, the retractable sleeve 212 is also be permitted to rotate axially about the female socket 210 as indicated by directional arrow A. The tab (or single protrusion) and slot dimensions are configured so as to provide a desired range of translational motion to the forward end 212*a* of the sleeve 212 beyond the face 210*a* of the female socket 210. The forward end 212*a* of the sleeve 212 is provided with a plurality of spaced apart, radially inwardly projecting nubs 216.

In operation, twist-lock engagement of the male electrical plug to the female socket is performed as follows. First, the conductor prongs 236 of the male electrical plug assembly 216 are inserted into the corresponding receiving holes of the female socket 210. The translatable and rotatable sleeve 212 is then moved into its extended position so that nubs 216 extend beyond the front face 210*a* of the female socket a distance sufficient to provide full engagement with the threads 292 of the face plate member 218 on the forward end of the male electrical plug assembly 216. Next, the user simply rotates the sleeve 212 in a tightening direction (e.g., clockwise for right hand thread, counter clockwise for a left hand thread). The tightening rotation of sleeve 212 rotates the nubs 216 into engagement with the threads 292 which pulls the conductor prongs 236 of the male electrical plug 216 the remaining distance into the corresponding receiving holes of the female socket 210. To disengage the male electrical plug 216 from the female socket 210, the rotation of rotatable sleeve 212 is reversed so that the threads 292 disengage from the nubs 216.

Figure 18:
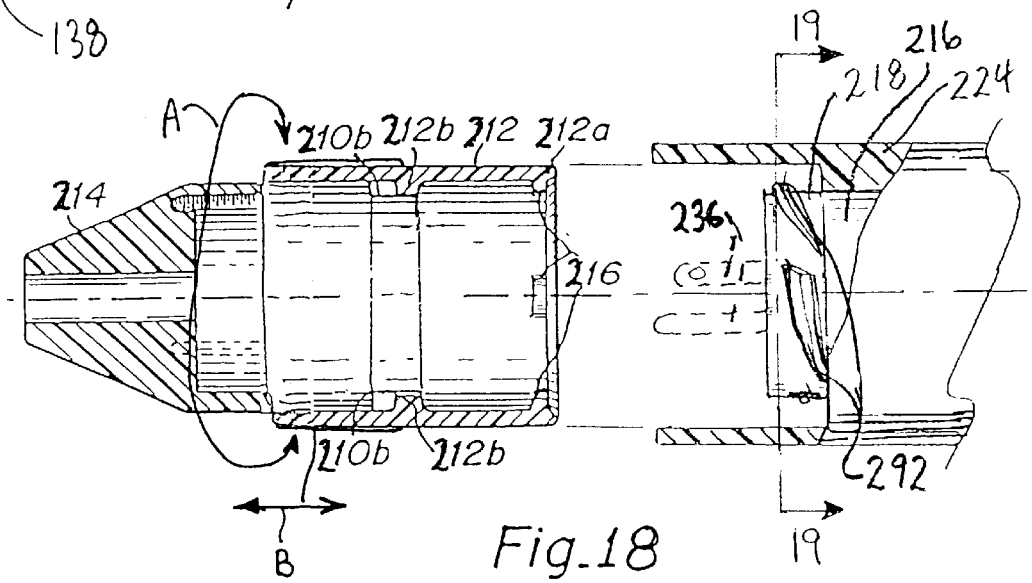
FIG. 18 is a side elevation cross sectional view of the twist-lock electrical connector assembly of FIG. 17.

The sleeve 212 preferably retracts a sufficient distance out of the way to permit use with conventional oversize plug connectors. The connecting structure of the embodiments shown in FIGS. 17 and 18 may be modified as desired to include the tapered dust seals of FIGS. 14–14A and the matching frusto-conical compression fit structure of FIG. 15.

Figure 19:
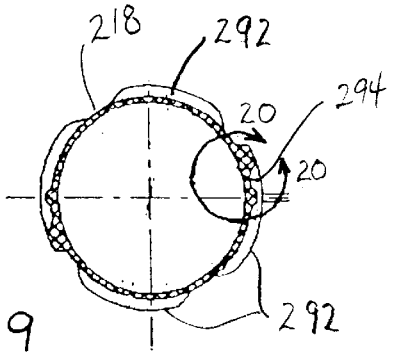
FIG. 19 is a cross sectional view through the prong end of the connector assembly taken along the line and in the directions of arrows 19—19 of FIG. 18.
Figure 20:
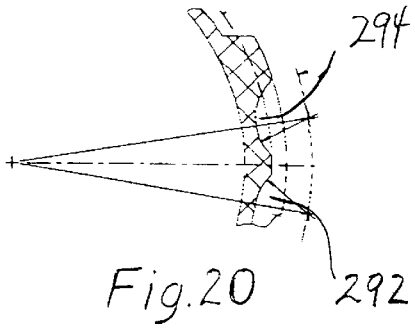
FIG. 20 is an enlarged section view of the region encircled by arrows 20—20 in FIG. 19.

Referring now to FIGS. 19–20, the outer perimeter surface of face plate 218 preferably includes one or more valleys or depressions 294 formed therein. The depressions 294 are configured to matingly receive a respective one of the projecting nubs 216 of the female sleeve 212 as the sleeve is rotated to engage the threads 292. The depressions 294 are positioned relative to the thread members 292 so as to define the end of the twist lock engagement between the sleeve 212 and the face plate member 218. In this way, the user can readily determine by feel whether a locked engagement exists so that over tightening of the connector assembly can be avoided.

While I have illustrated and described the preferred embodiments of my invention, it is to be understood that these are capable of variation and modification, and I therefore do not wish to be limited to the precise details set forth, but desire to avail ourselves of such changes and alterations as fall within the purview of the following claims.

I claim:

1. A handle assembly for use with an electrical apparatus to provide secure connection of the electrical appliance with a female socket that has a sleeve enclosing the socket and rotatably coupled to the socket, the sleeve including a forward sleeve end having an inner cylindrical wall provided with a plurality of spaced apart, radially inwardly projecting nubs, the handle assembly comprising:

a handle adapted to support the electrical apparatus, the handle having a recess formed therein; and an electrical plug adapted for twist-lock engagement with the female socket, the electrical plug being integrated with the handle and being disposed inside the recess;

wherein the electrical plug comprises:

a face plate member connected to a prong end of the electrical plug, said face plate member having an outer cylindrical wall provided with a plurality of thread members for lockingly engaging the nubs of the sleeve; and wherein rotation of the sleeve causes the threads to engage the nubs and draw the electrical plug into engagement with the female socket.

2. The handle assembly of claim 1, wherein the plurality of thread members are discontinuous.

3. The handle assembly of claim 1, wherein the face plate member includes one or more depressions formed on the outer cylindrical wall, each one of the one or more depressions being configured for positive receiving engagement with one of the nubs to define an end to twist-lock movement of the sleeve.

4. The handle assembly of claim 1, wherein the face plate member is integrally formed with said prong end of said electrical plug.

5. The handle assembly of claim 1, wherein the recess is sized to receive the sleeve therein.

6. A handle assembly for use with an electrical apparatus to provide secure connection of the electrical appliance with a female socket that has a sleeve enclosing the socket and rotatably coupled to the socket, the sleeve including a forward sleeve end having an inner cylindrical wall provided with a plurality of spaced apart, radially inwardly projecting nubs, the handle assembly comprising:

a handle adapted to support the electrical apparatus, the handle having a recess formed therein; and an electrical plug adapted for twist-lock engagement with the female socket, the electrical plug being integrated with the handle and being disposed inside the recess;

wherein the electrical plug comprises:

a face plate member connected to a prong end of the electrical plug, said face plate member having an outer cylindrical wall provided with a plurality of thread members for lockingly engaging the nubs of the sleeve; and wherein rotation of less than half a turn of the sleeve causes the threads to engage the nubs and draw the electrical plug into locked engagement with the female socket.

7. The handle assembly of claim 6, wherein the plurality of thread members are discontinuous.

8. The handle assembly of claim 6, wherein the face plate member includes one or more depressions formed on the outer cylindrical wall, each one of the one or more depressions being configured for positive receiving engagement with one of the nubs to define an end to twist-lock movement of the sleeve.

9. The handle assembly of claim 6, wherein the face plate member is integrally formed with said prong end of said electrical plug.

10. The handle assembly of claim 6, wherein the recess is sized to receive the sleeve therein.

11. A handle assembly for use with an electrical garden tool to provide secure connection of the electrical garden tool with a female socket that has a sleeve enclosing the socket and rotatably coupled to the socket, the sleeve including a forward sleeve end having an inner cylindrical wall provided with a plurality of spaced apart, radially inwardly projecting nubs, the handle assembly comprising:

a handle adapted to support the electrical garden tool, the handle having a recess formed therein; and an electrical plug adapted for twist-lock engagement with the female socket, the electrical plug being integrated with the handle and being disposed inside the recess;

wherein the electrical plug comprises:

a face plate member connected to a prong end of the electrical plug, said face plate member having an outer cylindrical wall provided with a plurality of thread members for lockingly engaging the nubs of the sleeve; and wherein rotation of less than half a turn of the sleeve causes the threads to engage the nubs and draw the electrical plug into locked engagement with the female socket.

* * * * *